US008773420B2

(12) United States Patent
Van Ess et al.

(10) Patent No.: US 8,773,420 B2
(45) Date of Patent: Jul. 8, 2014

(54) DIGITAL DRIVING CIRCUITS, METHODS AND SYSTEMS FOR LIQUID CRYSTAL DISPLAY DEVICES

(75) Inventors: David Van Ess, Chandler, AZ (US); Christopher C. Keeser, Everett, WA (US); Robert L. Murphy, Seattle, WA (US); David G. Wright, San Diego, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 450 days.

(21) Appl. No.: 13/007,014

(22) Filed: Jan. 14, 2011

(65) Prior Publication Data

US 2011/0169814 A1 Jul. 14, 2011

Related U.S. Application Data

(60) Provisional application No. 61/294,977, filed on Jan. 14, 2010.

(51) Int. Cl.

| | |
|---|---|
| ***G09G 3/36*** | (2006.01) |
| ***G09G 3/04*** | (2006.01) |
| *G09G 3/20* | (2006.01) |

(52) U.S. Cl.

CPC ..... *G09G 3/3611* (2013.01); *G09G 3/2014* (2013.01); *G09G 2320/0204* (2013.01); *G09G 3/04* (2013.01); *G09G 3/36* (2013.01)

USPC ..... 345/212; 345/34

(58) Field of Classification Search

USPC ..... 345/45, 50, 212, 34; 340/324; 368/29; 324/403

See application file for complete search history.

(56) References Cited

U.S. PATENT DOCUMENTS

| | | | | |
|---|---|---|---|---|
| 4,100,540 | A * | 7/1978 | Fujita et al. | 345/52 |
| 4,141,853 | A | 2/1979 | Hibino et al. | |
| 4,453,128 | A * | 6/1984 | Steinmetz | 324/403 |
| 4,745,403 | A | 5/1988 | Tamura | |
| 5,166,610 | A * | 11/1992 | Bezos et al. | 324/160 |
| 5,859,625 | A | 1/1999 | Hartung | |
| 6,031,510 | A * | 2/2000 | Drake et al. | 345/50 |
| 6,326,943 | B1 * | 12/2001 | Inoue et al. | 345/101 |
| 6,683,587 | B2 * | 1/2004 | Gulsen | 345/38 |
| 6,937,212 | B2 * | 8/2005 | Brewer et al. | 345/34 |
| 2006/0250324 | A1 * | 11/2006 | Rosenquist | 345/34 |
| 2008/0284719 | A1 | 11/2008 | Yoshida | |

OTHER PUBLICATIONS

International Search Report of the International Searching Authority for International Application PCT/US11/21430 dated Mar. 15, 2011; 3 pages.

Written Opinion of the International Searching Authority for International Application PCT/US11/21430 dated Mar. 15, 2011; 13 pages.

(Continued)

*Primary Examiner* — Quan-Zhen Wang
*Assistant Examiner* — Yuk Chow

(57) ABSTRACT

A method may include controlling a display device in at least first mode by varying a correlation between display driver signals applied across display segments within the display device; wherein the display driver signals vary between substantially only two levels, and a display segment is activated when an average voltage magnitude across the segment over a time period exceeds a threshold value.

18 Claims, 9 Drawing Sheets

(56) References Cited

OTHER PUBLICATIONS

U.S. Appl. No. 13/755,709: "Digital Driving Circuits, Methods and Systems for Liquid Crystal Display Devices" David Van Ess et al., filed Jan. 31, 2013; 48 pages.
USPTO Final Rejection for U.S. Appl. No. 13/755,709 dated Oct. 8, 2013; 8 pages.
USPTO Non Final Rejection for U.S. Appl. No. 13/755,709 dated May 16, 2013; 10 pages.
USPTO Notice of Allowance for U.S. Appl. No. 13/755,709 dated Feb. 5, 2014; 8 pages.
USPTO Notice of Allowance for U.S. Appl. No. 13/755,709 dated Nov. 27, 2013; 7 pages.

* cited by examiner

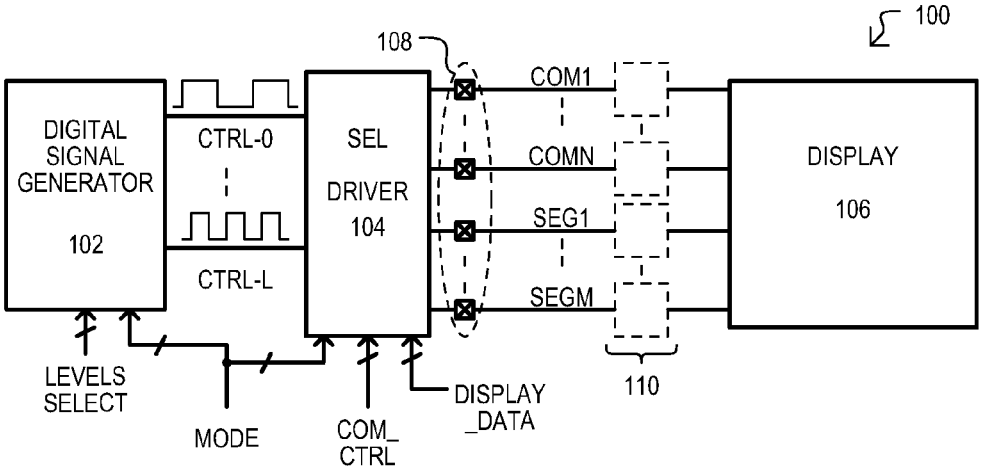
FIG. 1
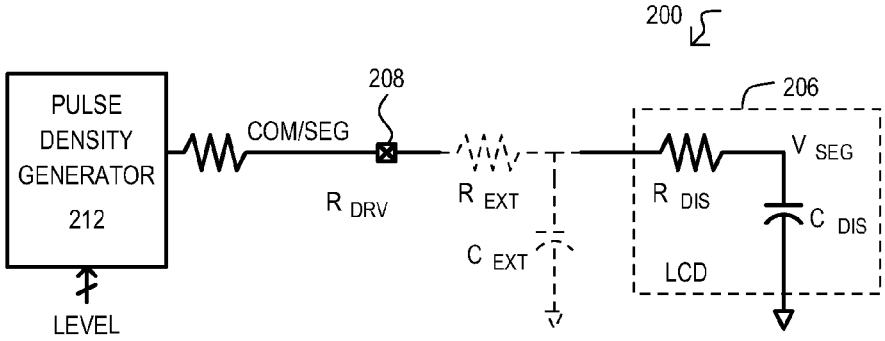
FIG. 2
FIG. 3
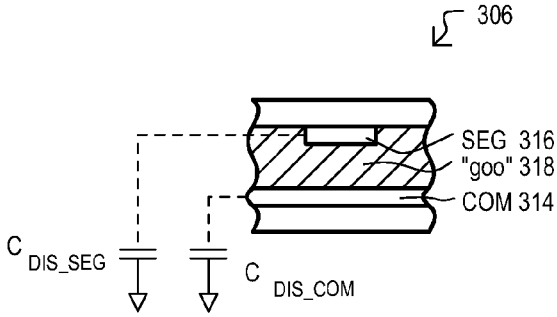

FIG. 5A
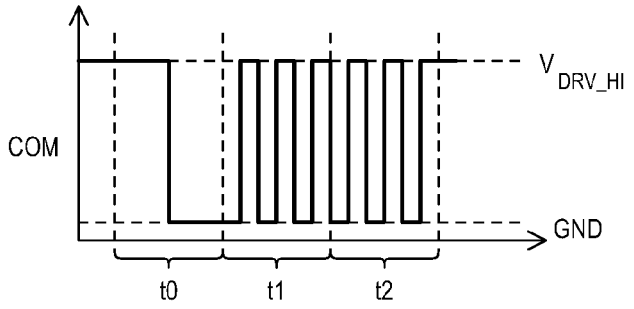
FIG. 5B
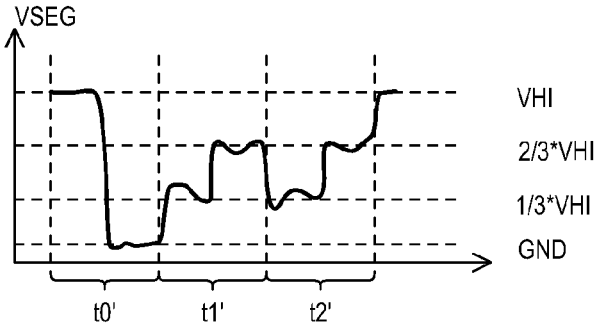
FIG. 6
| # of commons | 2 | | 3-6 | | 7-12 | | 13-20 | |
|---|---|---|---|---|---|---|---|---|
| LEVELS | 1/2 | 1 | 1/3 | 2/3 | 1/4 | 1/2 | 1/5 | 2/5 |
| Density Stream | 1 | 1 | 0 | 1 | 1 | 1 | 1 | 1 |
| | 0 | 1 | 1 | 1 | 0 | 0 | 0 | 0 |
| | | | 0 | 0 | 0 | 1 | 1 | 0 |
| | | | | | 0 | 0 | 0 | 0 |
| | | | | | | | 0 | 0 |
FIG. 7
| # of commons | 2-3 | | 4-5 | | 6-7 | | 8-10 | | 11-14 | | 15-18 | |
|---|---|---|---|---|---|---|---|---|---|---|---|---|
| LEVELS | 2/5 | 4/5 | 1/3 | 2/3 | 2/7 | 4/7 | 1/4 | 1/2 | 2/9 | 4/9 | 1/5 | 2/5 |
| Density Stream | 1 | 1 | 1 | 1 | 1 | 1 | 1 | 1 | 1 | 1 | 1 | 1 |
| | 0 | 1 | 0 | 1 | 0 | 0 | 0 | 0 | 0 | 0 | 0 | 0 |
| | 1 | 1 | 0 | 0 | 0 | 1 | 0 | 1 | 0 | 1 | 0 | 1 |
| | 0 | 1 | | | 1 | 0 | 0 | 0 | 0 | 0 | 0 | 0 |
| | 0 | 0 | | | 0 | 1 | | | 1 | 1 | 0 | 0 |
| | | | | | 0 | 0 | | | 0 | 0 | | |
| | | | | | 0 | 1 | | | 0 | 1 | | |
| | | | | | | | | | 0 | 0 | | |
| | | | | | | | | | 0 | 0 | | |

DIGITAL DRIVING CIRCUITS, METHODS AND SYSTEMS FOR LIQUID CRYSTAL DISPLAY DEVICES

This application claims the benefit of U.S. Provisional Patent Application Ser. No. 61/294,977, filed on Jan. 14, 2010, the contents of which are incorporated by reference herein.

TECHNICAL FIELD

The present disclosure relates generally to display control devices, and more particularly to display control devices that enable/disable display segments according to a voltage applied across such segments.

BACKGROUND

Display technologies, such as liquid crystal display (LCDs), can activate segments of a display according to signals applied across the segments. Conventionally, technology for driving LCDs directly requires dedicated hardware to generate and sequence specific analog voltage levels in order to properly drive a display. Waveforms are generated using such multiple signal levels to either turn on or off each segment. Typically, such multiple signal levels include a high bias voltage, and multiple other intermediate voltage levels proportional to the high bias voltage. A high bias voltage is typically an analog value that may be varied to increase or decrease a contrast of display segments. The generation of a variable high bias voltage and multiple intermediate voltages can be costly in terms of integrated circuit die area, and in some cases power.

A typical LCD display may include multiple "commons". Each common may be connected to a corresponding set of LCD segments. Commons may be driven to an analog selection voltage in a time division multiplexed fashion such that only one commons is driven to an analog selection voltage at a time. When not driven to a selection voltage, each common may be driven to one of many different analog de-selection voltage levels.

While LCDs segments may be activated by applying a voltage bias, in order to avoid damaging such segments, LCD controls signals must have an overall DC bias of zero.

For systems having N commons, voltages relative to the high bias value may include $1/(1+\sqrt{N})$, $2/(1+\sqrt{N})$. Further, to ensure a zero DC bias is maintained across each segment, additional values are needed that may be arrived at by "flipping" the previously voltage levels, which gives: $\sqrt{N}/(1+\sqrt{N})$ and $(\sqrt{N}-1)/(1+\sqrt{N})$.

As but one example, for a system having eight commons, the different analog voltage levels would be 0%, 28%, 56% and 100%. As noted above, to preserve a DC bias across a segment, you must complement (1−x %) these values, and thus include voltage levels 100%, 72%, 44% and 0%. Hardware to generate these levels can require the generation of the high bias voltage (100%), and the ability to generate the four levels proportional to this high bias level.

Such levels can be expressed in terms of a value α as follows:

$$V_C = \sqrt{N} * V_S$$

$$V_C + V_S = 100\%$$

$$V_C + V_S = 100\% \rightarrow V_S + \alpha * V_S =$$

$$100\% \rightarrow V_S * (1+\alpha) = 100\% \rightarrow V_S = \frac{100\%}{1+\alpha}$$

If resistor ladders are employed to voltage divide a high bias voltage, there may be overlap in the resistor ranges (α=1 and α=3) and some values can be reused, but for the most part, there may be little overlap, with each a setting needing its own set of resistors in the divider. Thus, for any system which plans to support many commons, a divider with many resistors must be constructed to generate the voltages. This also requires a complicated analog multiplexer to select the different voltage levels. Once the device is made, there may not exist a way to add more commons since the architecture is fixed.

One example of a conventional LCD driving arrangement is shown in FIGS. 16A and 16B. FIGS. 16A and 16B show an arrangement having three commons.

Referring to FIG. 16A a number of analog waveforms are shown, including a common waveform (COM0), two segment selection waveforms (SEG0, SEG1), and waveforms showing a resulting voltage difference between the common levels and segment selection levels (COM0-SEG0, COM0-SEG1). The waveforms show three timeslots t0, t1 and t2. Such three time slots may make up a frame.

As shown, common signal COM0 varies between a high analog bias voltage (Van_HI), and two values proportional to this voltage (Van_HI*(2/3), Van_HI*(1/3)), and a low voltage (GND). Signal COM0 is driven to a high selection level during timeslot t0.

Segment selection waveform SEG0 is driven with a selection state with respect to the signal COM0. Accordingly, as shown by the hatched portion of waveform COM0-SEG0, a voltage across a segment may exceed a threshold (Vth, −Vth), resulting in a segment being activated at timeslot t0. In timeslots t1 and t2, levels remain below Vth/−Vth, so the segment is not activated.

In contrast, segment selection waveform SEG1 is driven with de-selection state with respect to the signal COM0. Accordingly, as shown by waveform COM0-SEG0, a voltage across a segment never exceeds a threshold (Vth, −Vth), resulting in a segment remaining de-activated.

It is understood that FIGS. 16A and 16B show a very limited number of commons, and that LCD assemblies may include substantially larger numbers of commons (i.e., twenty or more), in which additional analog levels may be required.

Generating such selection and de-selection analog voltage levels can be quite expensive. As noted above, such analog circuits may be implemented with resistors, however such resistors must typically have tight tolerances. This can be costly in device area and/or require special process steps. Further, the analog circuitry require to generate multiple analog voltage levels may also be costly. Conventional analog control circuits for an LCD are shown in FIGS. 17A and 17B.

FIG. 17A shows a first portion of a conventional system 1700 that generates a high bias voltage v0 and four proportional intermediate voltages v1, v2, v3 and v4. System 1700 includes a band gap reference circuit 1702 that provides a temperature independent voltage Vbg to operational amplifier (op amp) 1704. Op amp 1704 may drive bias transistor P170. A drain of transistor P170 may be fed back to op amp 1704 by an adjustable feedback bias circuit that includes adjustment switches 1706, and resistances R1 and R2. In response to contrast input values CONTRAST, adjustment switches 1706 may vary resistance values R1/R2 to alter an op amp 1704 driving voltage to generate a desired high bias voltage v0 (where v0=(1+R1/R2*Vbg)).

A high bias voltage v0 may be provided to a resistance ladder network 1708 that may include high precision resistors for generating a large number of bias voltages to accommodate different display types, as well as varying numbers of commons. In response to bias select values (BIAS SELECT), a selection circuit 1710 may connect four generated analog output voltages from resistance ladder network 1708 as output voltage v1, v2, v3 and v4. It is understood that selection circuit 1710 is an analog circuit that must be capable of passing the various different analog voltage levels.

FIG. 17B shows a second portion of a conventional system 1700 that outputs one of many different analog voltages as a common signal or segment control signal. The various generated analog voltage v0, v1, v2, v3, v4 and GND may be selectively output from a first analog multiplexer (MUX) 1712 in response to common/segment (COM_SEG) selection values. Values output form first analog MUX 1712 may be selectively output to a buffer circuit 1716 from second analog MUX 1714 in response to display and frame data (DISP_DATA, FRAME). FIGS. 17A and 17B show how a conventional approach may require considerable analog circuit resources.

It is noted that to accommodate a wide range of LCD voltage levels, a high supply voltage (e.g., Vpwr_Hi in FIG. 17A) may be generated by a voltage digital-to-analog converter (VDAC), which may further add to the size and complexity of the system.

It is also noted that other conventional approaches may utilize charge pumps in lieu of resistance ladder networks to arrive at various analog bias voltages. Such an approach also consumes considerable die area and power.

BRIEF DESCRIPTION OF THE DRAWINGS

FIG. 1 is a block schematic diagram of a display control system according to one embodiment.

FIG. 2 is a block schematic diagram of a display control system that applies digital signals to a frequency filter, which may be formed with a display device, according to one embodiment.

FIG. 3 is a side cross sectional view showing a portion of a liquid crystal display (LCD) that may be included in embodiments.

FIGS. 5A and 5B are timing diagrams showing the operation of a display control system that utilizes digital signals and a filter, according to one embodiment.

FIG. 6 is a table showing pulse density stream values that may be included in embodiments.

FIG. 7 is a table showing other pulse density stream values that may be included in embodiments.

DETAILED DESCRIPTION

Figure 4A:
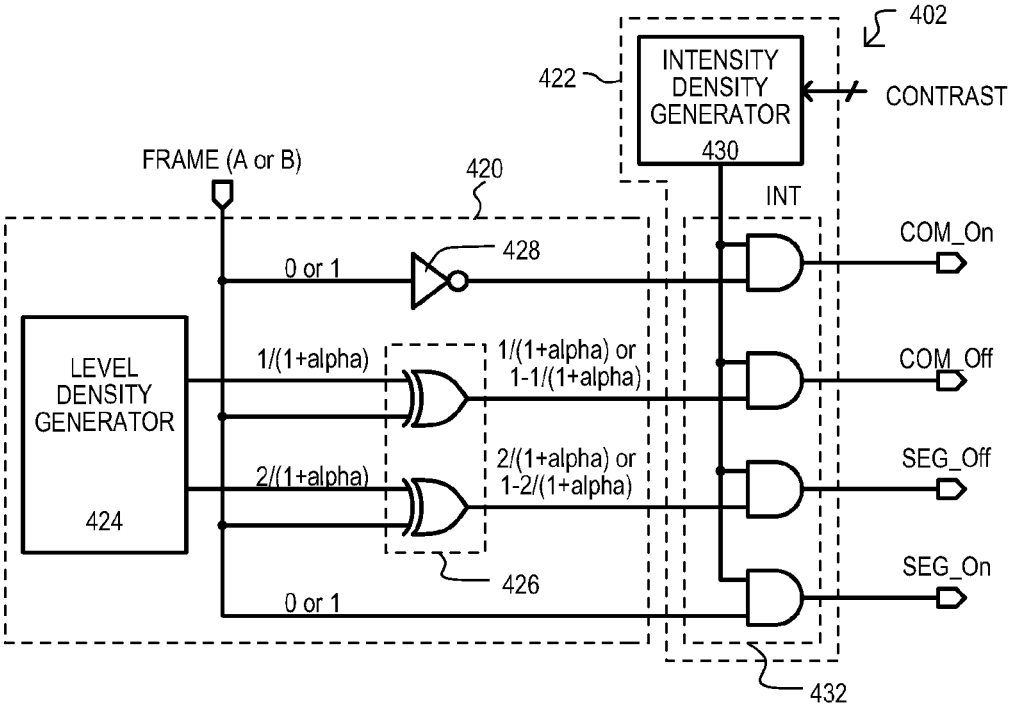
FIGS. 4A and 4B are block schematic diagrams of a display control system according to one embodiment.

Various embodiments will now be described that show circuits, systems and methods that can control a segmented display, such as a liquid crystal display (LCD), with digital (e.g., binary level) signals, and thus avoid analog circuits like those included in conventional approaches.

Some may generate display driver signals that vary between only two levels and are applied to opposing electrodes of a display segment. Correlation of such opposing driver signals may be used to select or de-select the segment based on an average voltage magnitude across the segment over a time period (e.g., root mean square).

Other embodiments may provide one or more driving methods in addition to the signal correlation method noted above, and enable switching between such different operating modes. One such alternate mode may include generating display driver signals that vary between only two levels, but may change in pulse density. An inherent features (e.g., capacitance and/or resistance) of a display (e.g., LCD display) may be utilized as all or part of a filter to cause the varying pulse densities to generate different voltage levels at segments of the display.

Referring to FIG. 1, a system according to one embodiment is shown in a block diagram and designated by the general reference character 100. A system 100 may include digital signal generator circuit 102, a selection driver circuit 104, and a display structure 106. A digital signal generator circuit 102 may generate a number of signals, each of which varies between two levels. That is, such signals may have binary levels and thus a digital signal generator circuit 102 may be implemented with digital circuits, and hence not include specialized analog circuits, as in the conventional approaches noted above.

In the embodiment shown, digital signal generator circuit 102 may generate control signals CTRL-0 to CTLR-L. Such signals may different pulse densities and/or waveform shapes (e.g., phase differences). Such different control signals may have varying degrees of correlation to one another. In addition, a selection driver circuit 104 may vary the types of control signals generated in response to a MODE signal.

A selection driver circuit 104 may selectively connect control signals (CTRL-0 to -L) to display connection points 108 to generate driver signals. In the very particular embodiment shown, such driver signals include common driver signals (COM1 to COMN) as well as segment driver signals (SEG1 to SEGM). It is understood that a selection driver circuit 104 can connect different control signals (CTRL-0 to -L) to display connection points 108 at different time periods (e.g., timeslots) to generate driver signals (COM1 to -N, SEG1 to -M) that are time division multiplexed (TDM).

Selection operations of selection driver circuit 104 may be made in response to common control signals (COM_CTRL), display data (DISPLAY_DATA), and MODE data. COM_CTRL signals may control a timing of multiplexing, while DISPLAY_DATA signals may vary according to a desired output of display structure 106. MODE data may indicate a type of operation. In one very particular embodiment, MODE data may indicate a higher power, higher performance node, as well as a lower power, power performance mode. Selection driver circuit 104 may have different signal sequencing operations depending upon MODE data.

It is noted that selection driver circuit 104 may also be a digital circuit, and thus may be implemented with digital logic. This is in sharp contrast to conventional analog circuit approaches that must be capable for passing multiple voltage levels.

Display structure 106 may include a display that may be controlled by signals received on display connection points 108. In one embodiment, a display structure may be an LCD display having a number of segments, each having first and second electrodes. Groups of first electrodes may be commonly driven by different common driver signals (COM1 to –N), while groups of second electrodes may be commonly driven by different segment driver signals (SEG1 to –M).

Optionally, a system 100 may include an impedance network 110 between connection points 108 and display structure 106. In some embodiments, an impedance network 110 in combination with inherent impedance values of display structure 106 may form a frequency filter for driver signals (COM1 to -N, SEG1 to -M).

In this way, a system may include a signal generator that generates multiple waveforms that vary between only two levels that may be selectively output as display driver signals, and vary according to two more different modes of operation.

As noted above, display properties, such as a capacitance of a display device may be leveraged to filter variable pulse density signals to generate different signal levels at segments of a display. In a very particular embodiment, capacitive properties of LCD glass in an LCD display may be leveraged to produce a low pass filter. Varying voltage levels can then be generated using a density modulation scheme rather than analog hardware. In some embodiments, display driver signals can be generated with pullup/pulldown mode output drivers with ~5K ohms of output impedance, (or alternatively a relatively small drive field effect transistor) and a sufficient low pass filter is thus generated on the glass.

In a very particular embodiment, a rough number for a capacitance of an LCD pixel may be ~15 pF/mm$^2$. This is about the size of a standard decimal point on a typical LCD display. At such a capacitance, a –3 dB point (e.g., cut off frequency) for an extremely small pixel may be about ~2 MHz. As noted above, in a typical LCD structure, there are multiple segments connected to a LCD display connection point. Thus, an overall capacitance at an LCD connection point may be much larger than 15 pF, and in some embodiment may be about ~200 pF. At such a capacitance a –3 dB point may be at about ~160 KHz. Thus, in an embodiment that may switch a driver signal between five states, a minimum clock speed at which a pulse density stream may be modulated may be about ~1 MHz.

Referring now to FIG. 2, one example of a system in one mode of operation according to an embodiment is shown in block diagram and designated by the general reference character 200. A system 200 may include a pulse density generator 212 that outputs a driver signal COM/SEG to display connection point 208. Signal COM/SEG may a digital signal that varies between two levels. In very particular embodiments, a pulse density generator 212 may include a signal generator circuit and selection driver circuit like those shown as 102/104 in FIG. 1. As shown, a system 200 may include an output driver resistance $R_{DRV}$.

A display structure 206 may be connected to display connection point 208 to receive driver signal COM/SEG. Display structure 206 may inherently include a display resistance $R_{DIS}$ and a display capacitance $C_{DIS}$. That is, the physical construction of the display structure 206 may create $R_{DIS}$ and $C_{DIS}$. In a particular embodiment, resistance $R_{DRV}$ and $R_{DIS}$ in combination with capacitance $C_{DIS}$ may form a low pass filter with respect to a modulating frequency of signal COM/SEG. That is, a modulating frequency may be outside of the pass band of such a low pass filter. Consequently, an output voltage VSEG may vary in level as a pulse density varies.

Optionally, a system 200 may include an additional resistance $R_{EXT}$ and/or additional capacitance $C_{EXT}$ to arrive at a desired filtering response.

The mode of operation shown for system 200 may be a higher power, higher performance mode.

In this way, in one mode of operation, a system may drive a display structure with a binary level signal, and utilize the inherent capacitance and resistance of the display structure as a low pass filter that transforms variable pulse density into varying voltage levels.

Referring now to FIG. 3, a portion of a display structure may be included in the embodiments is shown in a partial side cross sectional view and designated by the general reference character 306. A display structure 306 may be an LCD device that includes a number of common electrodes (one shown as 314) and segment electrodes (one shown as 316) separated by an LCD "goo" 318. A common electrode (e.g., 314) may have a capacitance $CD_{IS_COM}$, while a segment electrode (e.g., 316) may have a capacitance $CD_{IS_SEG}$. Such capacitances may form all or part of a low pass filter as described above.

In this way, a system may utilize an LCD as all or part of a low pass filter.

Because signals generated to control a display device are digital (e.g., transition between binary levels), hardware to generate such signals may be considerably smaller than that utilized in conventional analog approaches, like those noted above, for any reasonable number of commons (i.e., 32 commons).

A more detailed embodiment will now be described with reference to FIGS. 4A and 4B.

Referring now to FIG. 4A, a signal generator circuit according to an embodiment is shown in a block schematic diagram and designated by the general reference character 402. In one very particular embodiment, a signal generator circuit 402 may be one implementation of that shown as 102 in FIG. 1. In particular, signal generator 402 generate driver signals in a higher-power, higher-performance mode of operation.

A signal generator circuit 402 may include a control selection circuit 420 and an intensity control circuit 422. A control selection circuit 420 may include a level density generator circuit 424, frame logic circuits 426, and an inverter 428. A level density generator 424 may vary a density of a binary (i.e., two-level) signals to arrive at a desired level with respect to a low pass filter. In the embodiment shown, level density generator circuit 424 may generate intermediate signals, one corresponding to a level $1/(1+\alpha)$ and one corresponding to a level $2/(1+\alpha)$. Such signals may be output in conjunction with two static values, one corresponding to a FRAME signal, and the FRAME signal as inverted by inverter 428.

Frame logic circuits 426 may invert intermediate signals in response to signal FRAME. Thus, frame logic circuits 426 may output either intermediate signals output from level density generator 424 ($1/(1+\alpha)$ and $2/(1+\alpha)$), or their inverses, which may be correspond to levels $1-1/(1+\alpha)$ and $1-2/(1+\alpha)$, which are corresponding DC balancing levels.

Intensity control circuit 422 may include an intensity density generator 430 and combining logic 432. An intensity density generator 430 may generate a signal INT having a pulse density that varies in response to a value CONTRAST. In one embodiment, a signal INT is not correlated to signals output from control selection circuit 420. Accordingly, signal INT may be conceptualized as modulating an intensity of signals output form control selection circuit 420. Such a feature may provide for adjustable contrast of a display device.

In the very particular embodiment shown, signal generator circuit 402 may provide a common "on" control signal (COM_On), a common "off" control signal (COM_Off), a segment "off" control signal (SEG_Off), and a segment "on" control signal (SEG_On). To ensure zero bias DC values can be maintained, control signal COM_On may be a logic high in one frame section, and a logic low another frame section (as modulated by signal INT). Control signal COM_Off may be the $1/(1+\alpha)$ pulse stream for the one frame section and the inverse pulse stream $1-1/(1+\alpha)$ in the other frame section (as modulated by signal INT). Similarly, control signal SEG_Off may be the $2/(1+\alpha)$ pulse stream for the one frame section and the inverse pulse stream $1-2/(1+\alpha)$ in the other section (as modulated by signal INT). Control signal SEG_On may be a logic low in one frame section, and a logic high in another frame section (as modulated by signal INT).

Figure 4B:
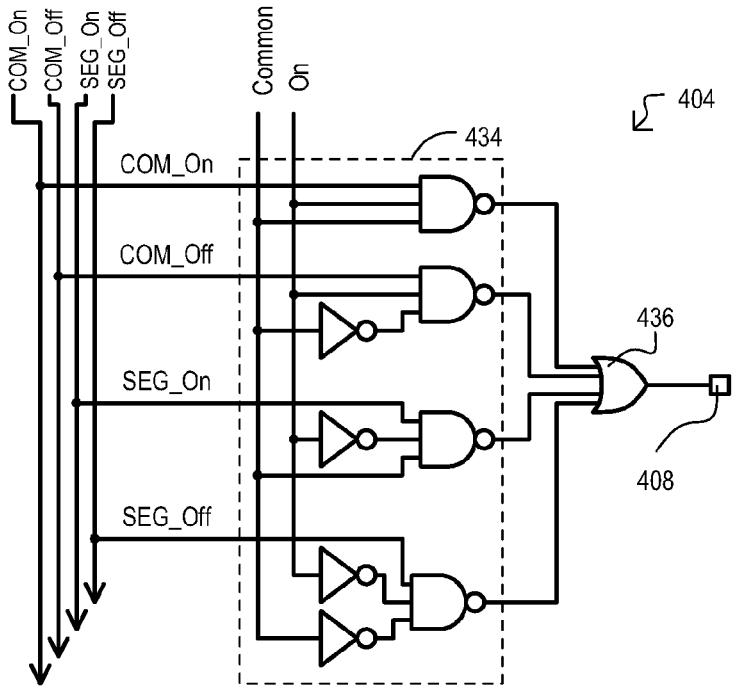

Referring now to FIG. 4B, a selection driver circuit according to an embodiment is shown in a block schematic diagram and designated by the general reference character 404. In one very particular embodiment, a selection driver circuit 404 may be one particular example of that shown as 104 in FIG. 1.

A selection circuit 404 may include signal selection logic 434 and output logic 436. In the very particular embodiment shown, a selection circuit 404 may provide the flexibility to output a common drive signal or a segment drive signal at a display device connection point 408. Signal selection logic 434 may select any of the control signal types (COM_On, COM_Off, SEG_Off, SEG_On) in response to signal Common and signal On. The Common signal indicates if the a particular signal is a Common drive signal (value 1) or a segment drive signal (value 0). The 'On' signal indicates if the segment should be illuminated for a corresponding common-segment signal combination. In FIG. 4B, output logic may be an OR gate with an output that drives a display connection point 408. As mentioned before, a driving power of output logic 436 may preferably be relatively weak to provide an output resistance suitable for a low pass filter formed with a display device, such as an LCD.

In this way, a binary level, pulse density modulated common drive signal or segment drive signal may be routed to a display connection point.

Referring to FIGS. 5A and 5B, two graphs represent a low pass filtering of a variable pulse density signal according to one embodiment. FIG. 5A shows a driver signal (COM) having a variable pulse density according to an embodiment. A signal COM may be generated by time division multiplexing control signals of different pulse densities. FIG. 5A shows timeslots t0, t1 and t2. Within each timeslot, signal COM varies between only two levels, $V_{DRV_HI}$ and GND. Further, within each timeslot a signal may be driven in a complementary fashion to help ensure a zero DC bias across a driven display segment.

Referring to FIG. 5A, in timeslot t0, signal COM may be driven to a highest level, followed by a complementary value, and can be conceptualized as a having a pulse density stream of "1, 1, 1". In timeslots t1 and t2, signal COM may be driven to a 1/3 proportional level (i.e., (i.e., $1/(1+\alpha)$ and $\alpha=2$), followed by a complementary value, and can have a pulse density stream of "0, 1, 0" (then 1, 0, 1).

FIG. 5B shows one particular response of a low pass filter, at least a portion of which is formed by the physical structure of a display device. FIG. 5B shows a corresponding segment voltage response VSEG. Waveform VSEG includes timeslots t0', t1' and t2' that represent a response to signal COM timeslots t0, t1 and t2, respectively. As shown, in response to the variations in pulse density, a voltage VSEG may vary between a levels VHI, 1/3*VHI, 2/3*VHI and GND.

It is understood that according to the number of commons, different pulse densities, and hence different pulse streams may be employed. As noted above, a number of levels may be arrived at by the relationships $1/(1+\alpha)$ and $2/(1+\alpha)$, where $\alpha=\sqrt{N}$, and N=number of commons.

FIG. 6 shows one very particular example of density stream that may be generated according to an embodiment when rounding a to whole number values. It is understood that each bit in the given density stream corresponds to a signal level in a corresponding portion of a timeslot.

FIG. 7 shows one very particular example of density streams that may be generated according to an embodiment when rounding a to a nearest ½ value. Of course, various other density streams may be arrived at according to a pulse density modulation stream, allowable frequency range, and desired precision, to name but a few of many factors.

It is noted that the density streams may be modulated to generate highest frequencies when possible. Such an approach may enhance the performance of a system by moving the frequencies well into the stop band of filter created by all or a portion of a display device.

In this way, pulse density bit streams may be generated to modulate a binary level signal to generate a desired signal level at a filtered output.

Figure 8A:
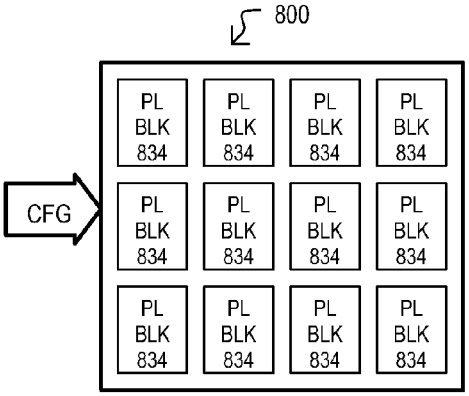
FIGS. 8A and 8B are block diagrams of a display control system and method that may include programmable digital blocks, according to an embodiment.
Figure 8B:
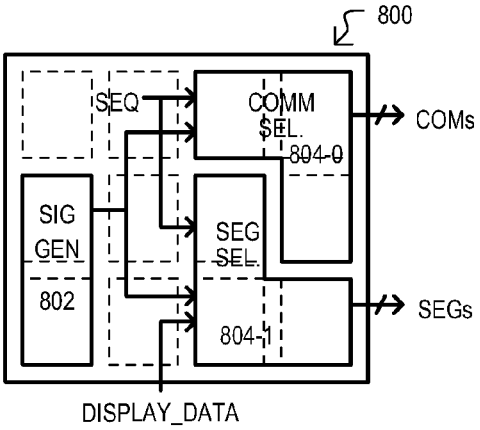

Referring now to FIGS. 8A and 8B, a method and system according to still further embodiments are shown in series a block diagrams. FIGS. 8A and 8B show system for generating LCD driver signals that may be implemented with programmable digital logic blocks.

FIG. 8A shows a system 800 that includes a number of digital programmable logic blocks 834. Such programmable logic blocks 834 may be programmed to provide particular digital logic functions and have particular digital signal interconnections in response to configuration data CFG.

FIG. 8B show a system 800 after configuration data has configured the digital programmable logic blocks into a signal generator circuit 802 and a selection driver circuit 804-0/1. In a very particular embodiment, system 800 may be one very particular implementation of that shown in FIG. 1.

A signal generator circuit 802 may generate signals having a particular density modulation as noted in embodiments above and equivalents. Such signals may be provided to selection driver circuits 804-0/1.

In the embodiment of FIG. 8B, the digital programmable logic blocks have been configured to provide a number of common drive signals (COMs) and segment drive signals (SEGs) to particular display connection points. More particularly, a selection driver circuit may include a common section 804-0 that generates common driver signals and segment section 804-1 that generates segment driver signals.

Common section 804-0 may generate common driver signals COMs in response to sequence control signals SEQ that vary between binary levels. In one particular embodiments, sequence control signals may generate common driver signals COMs that have repeating sequences.

In contrast, segment section 804-1 may generate selection driver signals SEGs in response to both sequence control signals SEQ and display data (DISPLAY_DATA). DISPLAY_DATA data may vary according to a desired display output. Consequently, segment driver signals (SEGs) may also vary in response to display data.

In this way, a system may include a common section that generates digital common driver signals having a pulse density that varies according to a sequence, and a segment section that generates digital segment driver signals having a pulse density that varies according to display data.

Figure 9A:
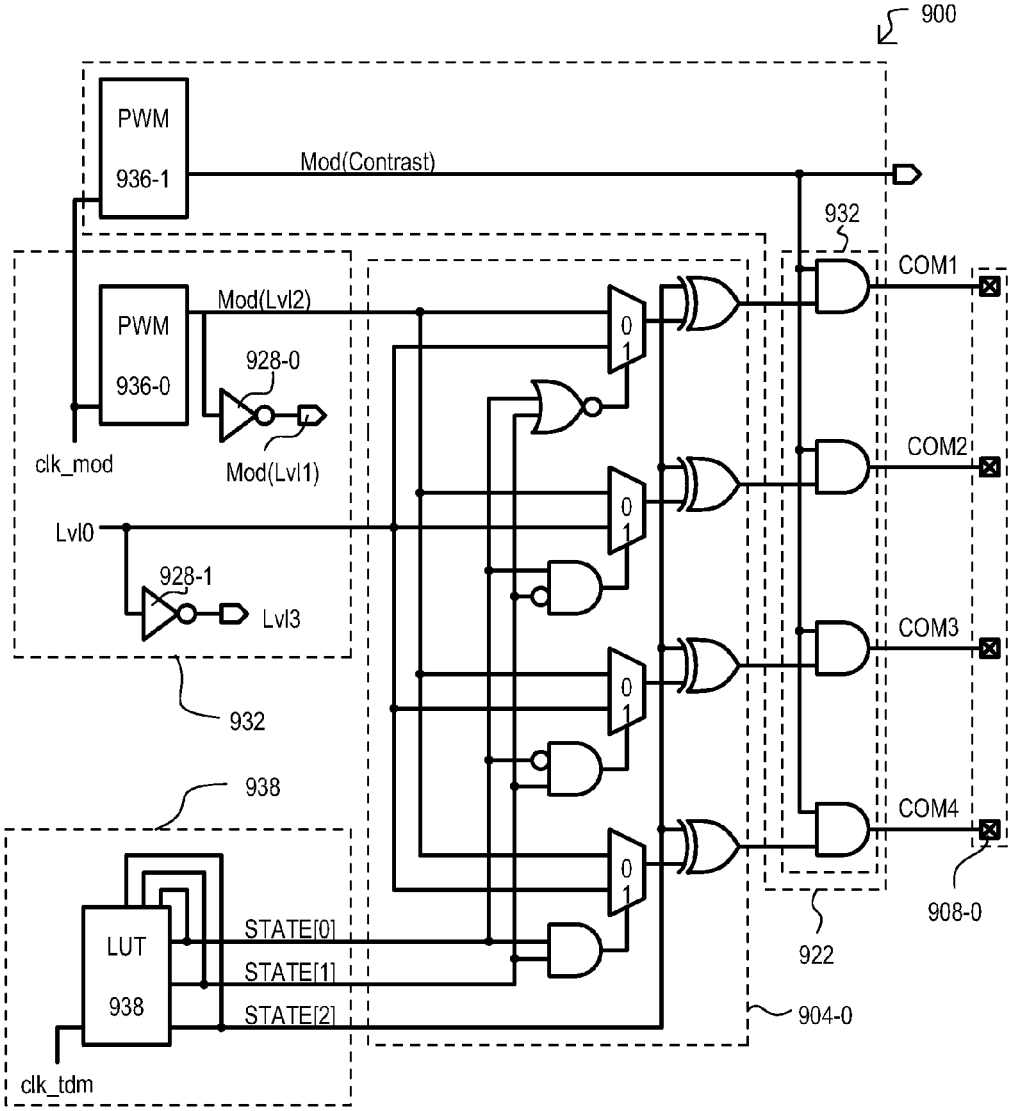
FIGS. 9A and 9B are block schematic diagrams of a display control system according to an embodiment.
Figure 9B:
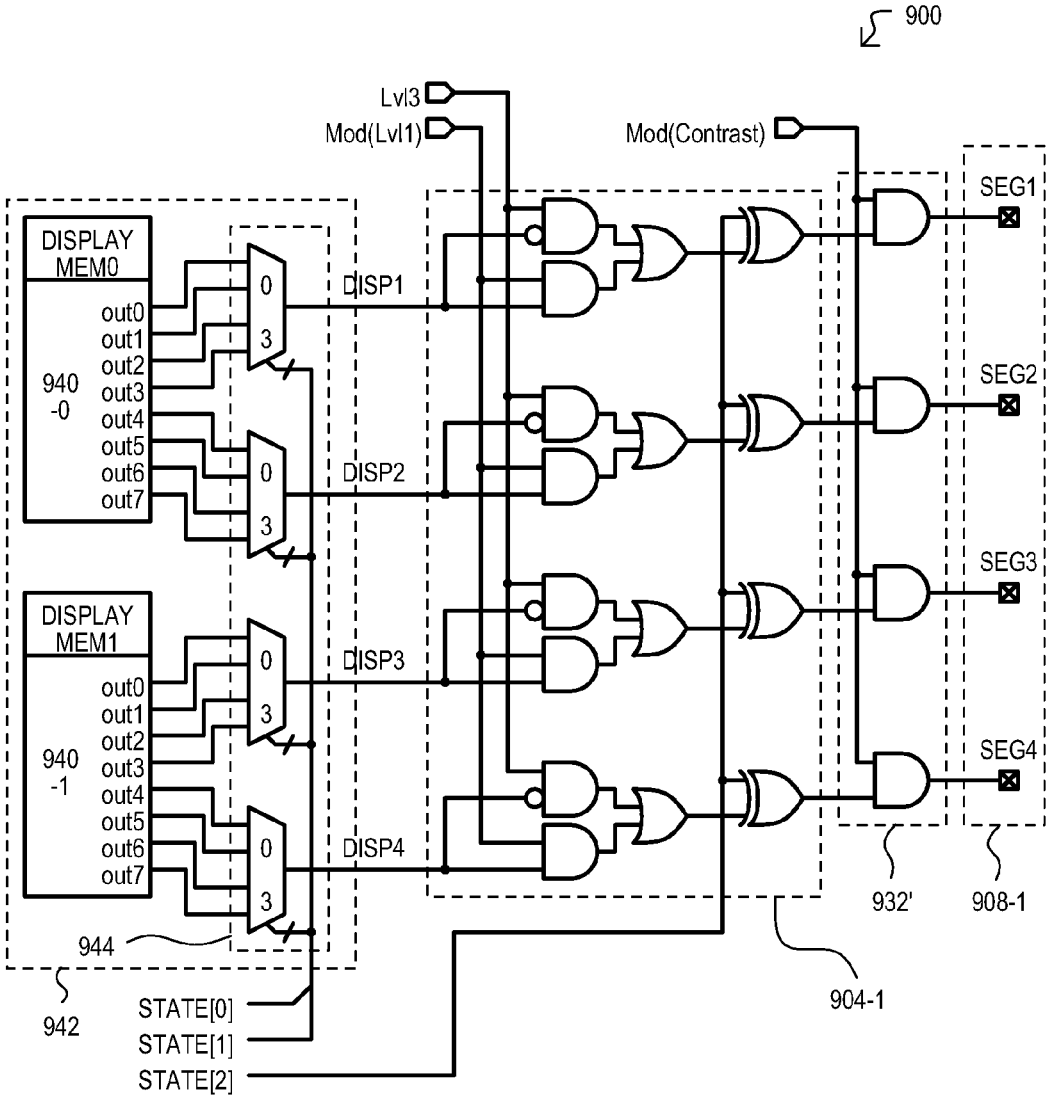

Referring now to FIGS. 9A and 9B, a system according to another embodiment is shown in series a block schematic diagrams and designated by the general reference character 900. In particular embodiments, system 900 may be a portion of one very particular implementation of that shown in FIG. 8B. A system 900 may generate driver signals that may be modulated to provide four different voltage levels (Lvl0, Lvl1, Lvl2, Lvl3) when filtered by an LCD.

Referring to FIG. 9A, a portion of system 900 is shown to include a signal generator circuit 902, a common section 904-0, an intensity control circuit 922, and a state machine circuit 938. A signal generator circuit 902 may include a pulse width modulation (PWM) circuit 936-0 and inverters 928-0 and -1. Pulse width modulation (PWM) circuit 936-0 may generate a binary signal Mod(Lvl2) according to a modulation clock (mod_clk) having a pulse density that generates a Lvl2 in a corresponding filter/LCD. Signal MOD(Lvl2) may be inverted by inverter 928-0 to generate a binary signal Mod(Lvl1) that generates a LW voltage in a corresponding filter/LCD. Signal generator circuit 902 may also provide a static low logic level signal "0", corresponding to Lvl0, and may invert such a signal to provide a static high logic level signal "1" that may correspond to Lvl3.

A common section 904-0 may include logic for selectively connecting either of signals Mod(Lvl2) or Lvl0 as output signals to intensity control circuit 922. Common section 904 may operate in response to state sequence signals STATE[0] to [3] provided state machine circuit 938.

An intensity control circuit 922 may include an intensity PWM circuit 936-1 and combining logic 932. Intensity PWM circuit 936-1 may generate a binary signal Mod(Contrast) having a pulse density that may modulate the outputs of common section 904-0 in the same manner as described for section 422 of FIG. 4.

A state machine circuit 938 may generate state sequence signals STATE[0] to [3] according to a time division multiplexing signal (clk_tdm). Such sequence signals (STATE[0] to [3]) may generate common driver signals COM1 to COM4 output signals that are time division multiplexed with frames of three timeslots. Only one common driver signal will be active (at Lvl0) in any given timeslot, each being at an inactive modulated state Mod(Lvl2) in the remaining timeslots. In the very particular embodiment shown, a state machine circuit 938 may include a look-up table (LUT) that sequences through states in synchronism with clk_tdm.

Common driver signals COM1 to –4 may be driven on corresponding display connection points 908-0, which may be connected to common inputs of an LCD display.

Referring to FIG. 9B, a second part of system 900 is shown to include a display data section 942, a segment section 904-1, and combining logic 932'. Display data section 942 may include display memories 940-0 and -1, and display data selection circuits 944. Display memories (940-0/1) may store data values corresponding a desired display response. In the particular embodiment shown, each display memory (940-0/1) may provide eight output values (out0 to out7) at a time. Data selection circuits 944 may selectively output values from display memories (940-0/1) in response to state sequence signals (STATE[0] and [1]) as display data DISP1 to DISP4.

Segment section 904-1 may include logic for selectively connecting either of signals Mod(Lvl1) or Lvl3 as output signals to combining logic 932' in response to display data DISP1 to –4 and state sequence signal STATE[2].

Combining logic 932' may modulate the outputs of segment section 904-1 in the same manner as described for section 422 of FIG. 4 according to signal Mod(Contrast).

Segment driver signals SEG1 to –4 may be driven on corresponding display connection points 908-1, which may be connected to common inputs of an LCD display.

In the embodiment of FIGS. 9A and 9B, the system shown was for an N=4 system, which only requires 4 bias levels (Lvl0=0, Lvl1=⅓, Lvl2=⅔ and Lvl3=1). As noted above, Lvl0 and Lvl3 represent 0 and 1 signal levels, while a ⅓ duty cycle PWM circuit 936-0 may generate LW and (by inverting) Lvl2. A LUT within state machine circuit 938 may step through eight states necessary to generate a type B (i.e., zero bias in two frames) LCD waveform with 4 commons.

In one embodiment, FIGS. 9A and 9B represent the hardware to control a 16 segment LCD element. Display memories (940-0/1) may be display random access memory (RAM) which store the desired state for each segment of the LCD element. State machine circuit 938 may be used to step through each timeslot (i.e., sub-frame) and the display memories (940-0/1) may be accessed to determine which of the 4 bias levels are required in order to generate the desired LCD waveform. In some embodiments, a modulation clock (mod_clk) may have a frequency greater than 1 MHz, preferably greater than 3 MHz. The approach illustrated by FIGS. 9A and 9B may be applied to systems having any number of commons, and with a sufficiently fast mod_clk, substantially any known LCD may be useable with such embodiments.

Embodiments of the invention may use high frequency digital signals (generated either through delta sigma modulation, pulse width modulation or any other suitable density modulation scheme) and the inherent low pass characteristics of a display, (such as an LCD) to apply a different bias voltage levels to the display without requiring specific analog hardware. The density of a digital signal applied to a display may be varied according to the bias voltage desired, and a state machine can properly sequence the modulated signal in order to influence the LCD. The modulated signal can also be mixed with another uncorrelated signal to adjust the discrimination ratio.

Embodiments above may use pulse density modulation in combination with a low pass filter, as noted above, for one mode of operation. Other embodiments may utilize signal correlation to drive an average voltage across a display segment to an active level (e.g., opaque in the case of an LCD). Such a signal correlation approach may be employed individually, or in combination with one or more other modes of operation. As but one example, correlation approaches may be utilized in combination with signal density approaches to provide two different modes of operation. More detailed examples of signal correlation embodiments will now be described.

Figure 10:
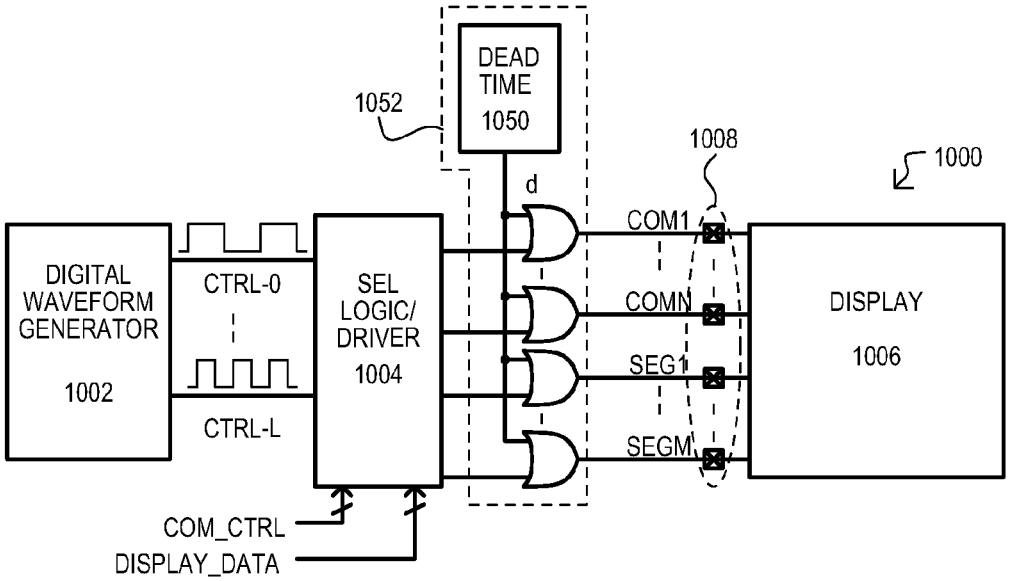
FIG. 10 is a block schematic diagram of a display control system that may rely on signal correlation to activate segments, according to one embodiment.

Referring now to FIG. 10, a system according to an alternate embodiment is shown in a block schematic diagram and designated by the general reference character 1000. A system 1000 may show another mode of operation for a system like of FIG. 1, and like sections are referred to by the same reference characters but with the leading digits being "10" instead of "1". Alternatively, FIG. 10 may be system that provides one mode of operation Digital signal generator 1002 may generate control signals CTRL-0 to CTRL-L that vary between two levels, some of which may correlate with one another, others of which may not correlate with one another. When signals correlate with one another, an average voltage difference between such signals, over a predetermined time period, may be large enough to activate a display segment. Conversely, when signals do not correlate with one another, such an average voltage difference may be insufficient to activate a display segment. In very particular examples, segments within display 1006 may be activated when a root mean square voltage (Vrms) exceeds a threshold value (Vrms_LCD_On), while non-correlated signals will not exceed Vrms_LCD_On. Thus, in the embodiment of FIG. 10, control signals (CTRL-0 to -L) may not be pulse density modulated according to a level value, but rather may be waveforms created to correlate or not correlate with one another.

A selection driver circuit 1004 may selectively connect control signals (CTRL-0 to -L) to display connection points 1008 to generate driver signals in the same manner as selection driver circuit 104 of FIG. 1.

However, unlike FIG. 1 common driver signals (COM1 to COMN) may be driven with various waveforms that may or may not correlate with corresponding segment driver signals (SEG1 to SEGM). Since an LCD segment will be on if the root mean square (RMS) voltage is above some threshold voltage, and off if the RMS voltage is below the threshold voltage, driver signals (COM1 to COMN, SEG1 to SEGM) may be generated by multiplexing a waveforms that can selectively activate segments, while keeping other segments off, based on such signals correlating with one another.

A system 1000 may also include a dead time control circuit 1052. A dead time control circuit 1052 may drive all driver signals (COM1 to COMN, SEG1 to SEGM) to a high level for a time period d, which may be established by timing circuit 1050. A dead time "d" may be selected to increase perceived contrast, as will be described in more detail below.

One method of generating waveforms and corresponding driver signals according to an embodiment will now be described with reference to FIGS. 11 and 12.

Figure 11:
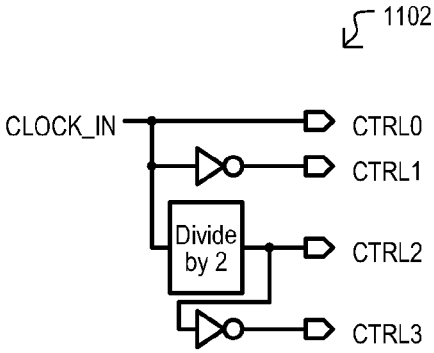
FIG. 11 is a block schematic diagram of a signal generator circuit that may be included in embodiments.

FIG. 11 shows one particular example of a signal generator circuit 1102, and may be one particular implementation of that shown as 1002 in FIG. 10. Signal generator circuit 1102 generates complementary signals CTRL0/1 that follow a clock signal (CLOCK_IN), and generates complementary harmonic signals (CTRL2/3) by frequency dividing signal CLOCK_IN by two and inverting the result.

It is understood that FIG. 11 is provided as but one type of correlation between two signals. Alternate embodiments may include various other types of waveforms to arrive and correlating (i.e., average voltage over time adequate to activate display segment) and non-correlating signals (i.e., average voltage over time noe adequate to activate display segment).

Figure 12:
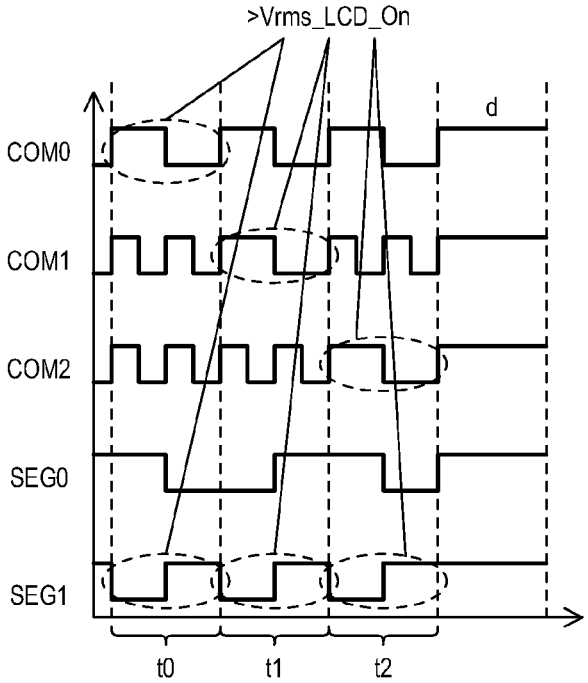
FIG. 12 is a timing diagram showing display device control using signal correlation according to an embodiment.

FIG. 12 shows examples of driver signals that may be generated by multiplexing control signals shown in FIG. 11. Thus, driver signal COM0 may be generated by outputting signal CTRL2 in timeslots t0 to t2. Signal COM1 may be generated by outputting signal CTRL0 in timeslots t0 and t2, and signal CTRL2 in timeslot t1. The remaining signals COM2, SEG0, SEG1 are generated in the same general fashion. Further, all signals (COM0/1/2, SEG0/1) are driven high in the dead time period after timeslot t2.

FIG. 12 shows how signals may correlate with one another. In particular, in timeslot t0, signals COM0 and SEG1 may correlate with one another by a sufficient amount so as to exceed the threshold (Vrms_LCD_On). Thus, display segment(s) connected between such signals would be activated. In timeslot t1, signals COM1 and SEG1 correlate with one another. In timeslot t2, signals COM2 and SEG1 correlate with one another. It is noted that signal SEG0 never has sufficient correlation with any of the common signals (COM0/1/2) to exceed Vrms_LCD_On.

As noted above, in particular embodiments a display (e.g., LCD) segment state may be understood by taking the difference between the common driver signal and the segment driver signal applied to the segment. If the RMS voltage is above the threshold, the segment is on, otherwise the segment is off. The waveforms of FIG. 13 further illustrate that point.

Figure 13:
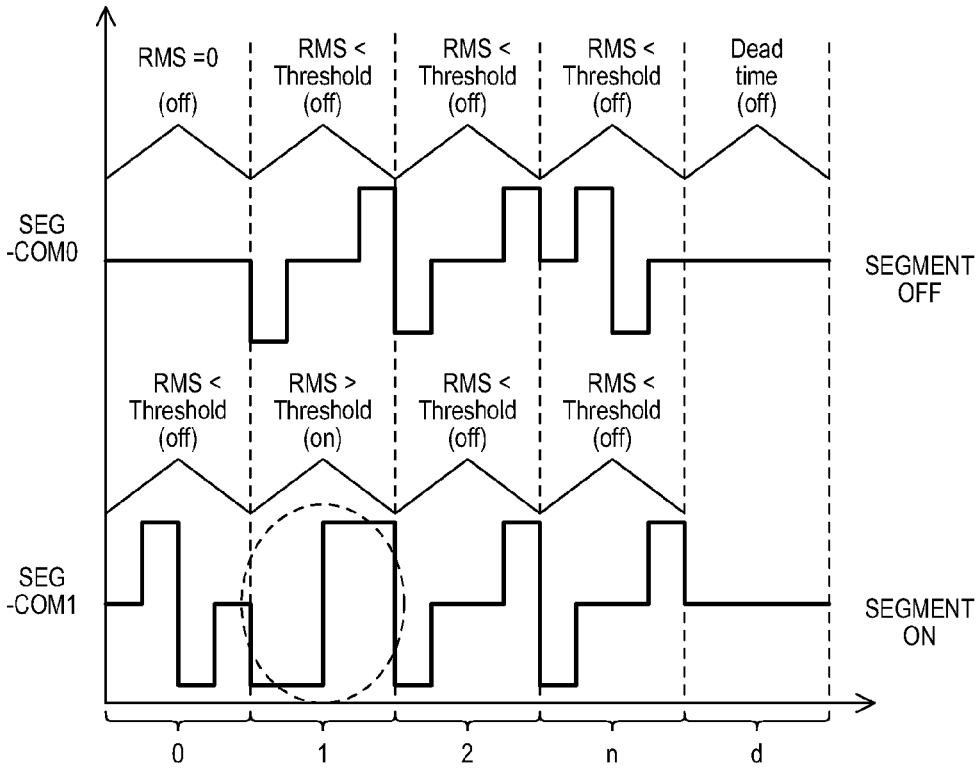
FIG. 13 is a timing diagram showing segment selection and de-selection waveforms according to one embodiment.

FIG. 13 shows two waveforms which represent a voltage difference across two segments caused by a segment driver signal (SEG) and two different common driver signals (COM0, COM1). Waveform SEG-COM0 which in an "off" segment, while waveform SEG-COM1 results in an "on" segment. An RMS voltage applied to such segments may be derived as follows. In the case of the "off" segment"

$$\sqrt{\frac{1*(0)^2+(n-1)*\left(\frac{1}{4}*(-1)^2+\frac{1}{4}*(1)^2\right)+d*(1*(0)^2)}{n+d}}=V_{RMS(off)}$$

After reduction, this becomes:

$$\sqrt{\frac{(n-1)*\frac{1}{2}}{n+d}}=V_{RMS(off)}$$

For the "on" case:

$$\sqrt{\frac{\frac{1}{2}*(-1)^2+\frac{1}{2}*(1)^2+(n-1)*\left(\frac{1}{4}*(-1)^2+\frac{1}{4}*(1)^2\right)+d*(1*(0)^2)}{n+d}}=V_{RMS(off)}$$

After reduction:

$$\sqrt{\frac{1+(n-1)*\frac{1}{2}}{n+d}}=V_{RMS(on)}$$

It is noted that a dead time "d" can range from 0 to infinity, and "n'" can also range from 1 to infinity. In the case that n=1 and d=0, Vrms(on)=sqrt(1)=1 and Vrms(off)=sqrt(0)=0. If a threshold voltage for a display segment is 0.5, then when n=1 and d=0, the segment will operate as desired (this is basically a static LCD drive). The RMS "on" voltage will be 1 volt, and the RMS "off" voltage will be 0 volts. Thus, such an arrangement may be acceptable when the segment turns "on" above 0.5, and "off" below 0.5 volts.

However, actual LCDs may have a less defined "on" and "off" voltage. An "on" and "off" may be defined as voltages that cause the segment to darken to within 90% of its maximum ("on"), and below 10% of the minimum ("off"). To better understand such actual LCD dynamics, an AC signal was applied to a real LCD, and the perceived darkness level was plotted for different RMS voltages applied (normalized to the maximum allowable LCD voltage). Results of such observations are shown in a graph in FIG. 14.

Figure 14:
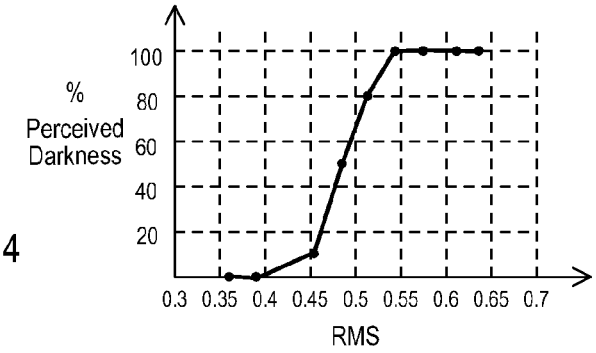
FIG. 14 is a graph showing perceived LCD segment darkness relative to root mean square (RMS) voltage applied across the segment.

FIG. 14 shows that in order for the observed LCD display to have crisp "on" and "off" states, it was desirable to have a certain minimum separation between the "on" and "off" voltages. In particular, if the RMS on voltage is above 0.53, a segment has a desirable "on" appearance, and if the RMS voltage is below 0.45, the segment has a desirable "off" appearance.

Referring back to the RMS calculations, in the case that n=4 and d=0, Vrms(on) is sqrt((1+3/2)/4)=sqrt(5/8)=~0.79, and Vrms(off)=sqrt((3/2)/4)=sqrt(3/8)=0.612. In such an arrangement, the LCD will have an undesirable appearance as both voltages exceed the turn-on target RMS voltage of 0.53.

To remedy this problem, the inventors noted that a dead time "d" could be adjusted. If d=3, Vrms(on) will become sqrt((5/2)/7)=0.59, and Vrms(off) will be sqrt((3/2)/7)=0.46. This means the "on" segment will be activated, but the "off" segment will be slightly darkened, causing the LCD to look less defined.

Figure 15:
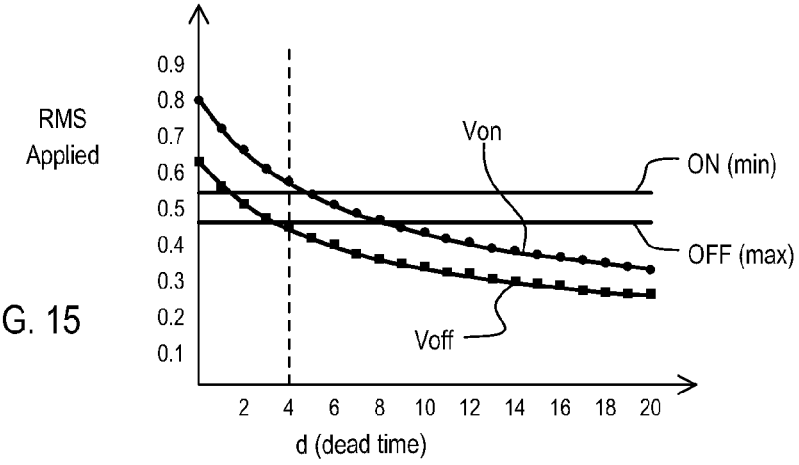
FIG. 15 is a graph showing a "dead time" effect on LCD segment control voltages according to an embodiment.
Figure 16A:
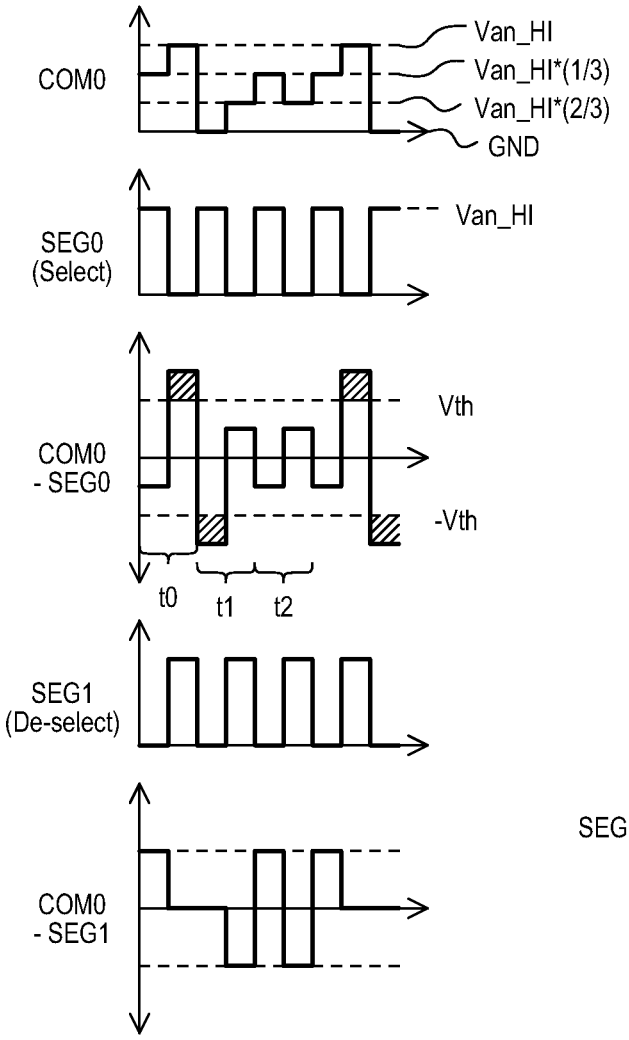
FIG. 16A (BACKGROUND ART)
FIGS. 16A and 16B are diagrams showing a conventional LCD control approach.
Figure 16B:
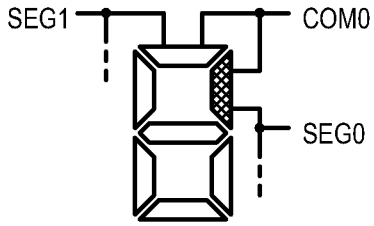
FIG. 16B (BACKGROUND ART)
Figure 17A:
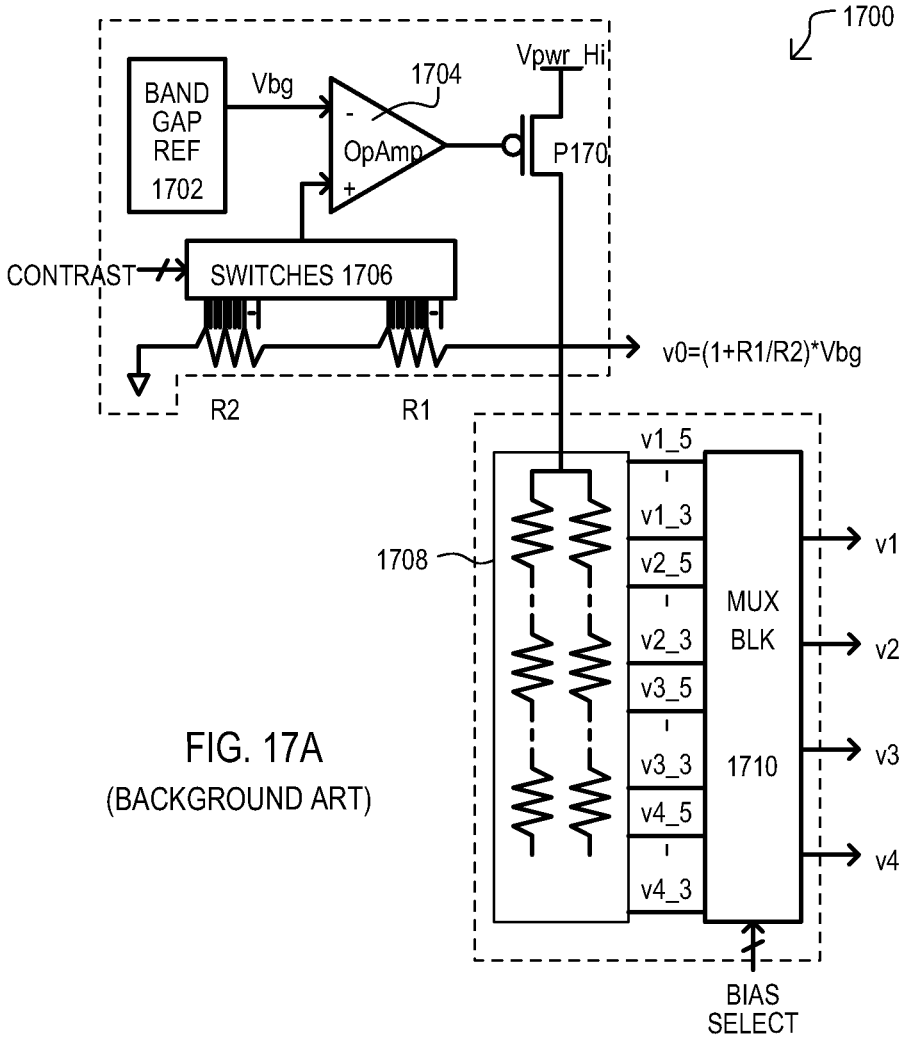
FIG. 17A (BACKGROUND ART)
FIGS. 17A and 17B are diagrams showing a conventional LCD control circuits.
Figure 17B:
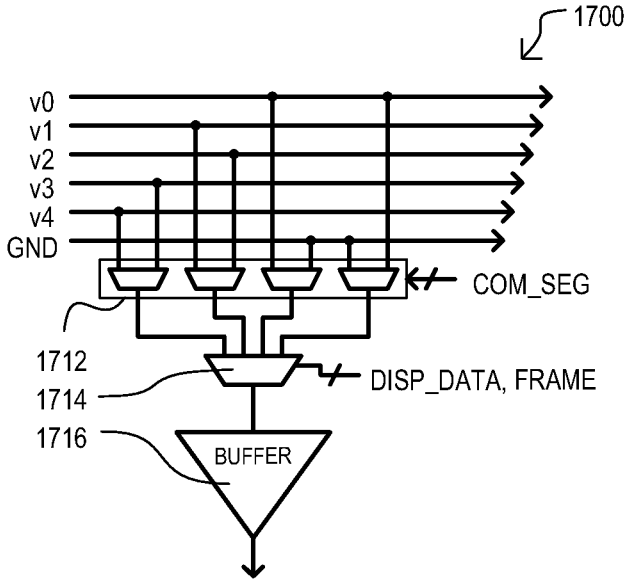
FIG. 17B (BACKGROUND ART)

Increasing d to 4 causes Vrms(on) to be 0.55 and Vrms(off) to be 0.43, which results in a desirable contrast response. It is noted that continued increases to "d" cause the "off" segments to have less contrast, and causes a reduction in the "on" voltage below the ideal point, which can result in the entire display starting to look dim. FIG. 15 illustrates this relationship.

As shown in FIG. 15, setting a dead time to four (d=4) can achieve a best response for the system. It is understood that different LCDs can have different responses. Further, arriving at a best response may also differ based on a number of commons and type of signal correlation used. Accordingly, the particular embodiment shown in FIGS. 13 to 15 can be considered a guide to arrive at settings that would be applicable to other systems by one skilled in the art.

Referring still to FIGS. 13 to 15, another metric for an LCD display is a contrast ratio. A contrast ratio may be a ratio of Vrms(on) to Vrms(off), and may help in determining how much room there is between an "on" segment and an "off" segment. When there is more distance between the two, it can be easier to clearly define an "on" segment and an "off" segment without having to compromise on the clarity of the "on" segments.

For the particular drive scheme show previously, a contrast ratio can be given as:

$$\frac{V_{RMS(on)}}{V_{RMS(off)}} = \frac{\sqrt{\dfrac{1+(n-1)*\frac{1}{2}}{n+d}}}{\sqrt{\dfrac{(n-1)*\frac{1}{2}}{n+d}}} = \sqrt{\frac{1+(n-1)*\frac{1}{2}}{(n-1)*\frac{1}{2}}} = \sqrt{\frac{n+1}{n-1}}$$

It is noted that the contrast ratio does not depend on dead time (d). For n=1, the contrast ratio is ∞, but for $$n = 2, \sqrt{\frac{3}{1}} = 1.73 \text{ and } n = 4, \sqrt{\frac{5}{3}} = 1.29.$$

As n increases, the voltage "distance" between on and off states will become smaller and smaller, as shown by the contrast ratio getting smaller. The smaller the contrast ratio, the more a system will have to depend upon the LCD physical features (e.g., the LCD goo properties) to have a sharply defined "off" to "on" transition, since the difference between the generated "on" and "off" voltages will be small. If the example with n=4 is revisited, we see that in all cases, the ratio of the on and off voltages was 1.29 (ignoring rounding error) (0.79/0.612=1.29, 0.59/0.46=1.29, 0.55/0.43=1.29).

Referring to FIG. 14, it is shown that a contrast ratio of at least 1.25 (0.54/0.43) is desirable for a clear definition of the on and off segments. The above proposed method, arriving at a contrast ratio of 1.29, meets such a response.

In the embodiments above, the hardware utilized to implement display driver signals may be digital circuits (i.e., circuits that operate at binary levels). The hardware necessary to implement an analog LCD driver, such as the conventional approaches above, can be large in comparison to the proposed digital implementations. Accordingly, significant savings in silicon die area can be obtained by replacing a traditional analog LCD drive implementation with a digital topology like those of the embodiments, or equivalents.

The embodiments, and equivalents, have the ability to be scaled to any number of commons and segments with minimal hardware requirements.

Embodiments of the invention may also provide savings in power consumption as compared to conventional approaches. By utilizing digital (i.e., binary level) circuits, a corresponding display can be driven by a system "waking" from a low power sleep mode, driving display pins between logic high and low levels, then going back to the low power sleep mode. This can provide for a faster transition between sleep and wake states as compared to conventional analog circuit approaches, as time is not needed for analog DAC circuits to be stabilized since the driven display control signal levels are at logic levels. In the case of an LCD system, a drive mode can be left alone and it may not be necessary to rely on the LCD glass to store charge during a sleep interval.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claims require more features than are expressly recited in each claim. Rather, inventive aspects lie in less than all features of a single foregoing disclosed embodiment. Thus, the claims following the detailed description are hereby expressly incorporated into this detailed description, with each claim standing on its own as a separate embodiment of this invention.

What is claimed is:

1. A method comprising:

generating display driver signals that vary between only two levels, wherein the display driver signals comprise common drive signals and segment drive signals;

applying the display driver signals to opposing electrodes of a display element within a display device; and controlling the display device in a first mode by varying a pulse density of the display driver signals applied to the opposing electrodes to select or de-select the display element and filtering the display driver signals applied to the opposing electrodes using electrical characteristics of at least a portion of the display device in the first mode to provide voltage levels at the display element to vary according to pulse density; wherein the display element is activated in the first mode when a first average voltage magnitude across the element exceeds a first minimum average voltage over a first time period, and varying a correlation between the common drive signals and the segment drive signals in a second mode to select or de-select the display element based on a second average voltage magnitude across the display element over a second time period, wherein the display element is activated in the second mode when the second average voltage magnitude exceeds a second minimum average voltage over the second time period, wherein the second average voltage magnitude exceeds the second minimum average voltage when a respective one of the common drive signals and the corresponding one of the segment drive signals are correlated and the second average voltage magnitude does not exceed the second minimum average voltage when the respective one of the common drive signals and the corresponding one of the segment drive signals are not correlated.

2. The method of claim 1, wherein the varying the correlation between display driver signals comprises generating a plurality of common driver signals that each comprises frames of N timeslots, including one selection timeslot and N−1 de-selection timeslots, the selection timeslot being different for each common driver signal.

3. The method of claim 2, wherein the varying the correlation between display driver signals comprises generating at least one segment driver signal comprising frames of N timeslots corresponding to the common driver signals, and wherein the display element is activated when the second average voltage magnitude between corresponding common and segment driver signals exceeds the second minimum average voltage in a timeslot.

4. The method of claim 2, further comprising:

each common driver signal repeats every frame; and generating at least one segment driver signal comprising frames of N timeslots corresponding to the common driver signal, the segment driver signal varying a correlation to at least one common driver signals in response to display data.

5. The method of claim 1, wherein the filtering the display driver signals comprises filtering with a frequency filter that comprises at least the portion of the display device, wherein the display device is a liquid crystal display device.

6. The method of claim 1, further comprising switching between at least the first mode and a second mode in response to a mode indication.

7. The method of claim 6, wherein the second mode is a low power mode and the first mode is a higher power mode.

8. A method comprising:

generating a plurality of time division multiplexed common driver signals and segment driver signals that vary substantially between only two levels;

applying the plurality of time division multiplexed common driver signals and segment driver signals to electrodes of display elements within a display device;

in a first mode, activating a first one of the display elements by varying a pulse density of one of the common and segment driver signals connected to the first display element and filtering the driver signal to provide voltage levels across the first display element that vary according to pulse density, wherein the first display element is activated when a first average voltage magnitude across the first display element over a first time period in the first mode exceeds a first minimum average voltage; and in a second mode, generating common driver signals that vary according to a predetermined sequence; and generating segment driver signals that selectively correlate with at least one common driver signal in response to display data to exceed a second minimum average voltage over a second time period; wherein a display element is activated or not activated depending upon whether a voltage exceeds the second minimum average voltage over the second time period.

9. The method of claim 8, wherein the common and segment driver signals comprises frames, each comprising a plurality of timeslots, and the time period comprises one of the timeslot.

10. The method of claim 8, further comprising:

in the first mode, generating common driver signals comprising variable pulse densities, and filtering the common driver signals to generate the varying voltage levels received by the display elements, wherein the filtering the common driver signals comprises forming a frequency filter that comprises at least the portion of the display device, wherein the display device is a liquid crystal display.

11. The method of claim 8, further comprising varying a pulse density of at least one of the common driver signals or the segment driver signals in response to an intensity value.

12. A system comprising:

a plurality of programmable digital blocks coupled to display elements of a display device, wherein the plurality of programmable digital blocks are configured into the following:

a first signal generator circuit that generates control signals that vary between substantially only two levels; and a selection driver circuit comprising a first mode that selectively couples selected controls signals to common display connection points, and selectively couples selected control signals to segment connection points in response to at least display data, wherein the selected control signals are filtered using electrical characteristics of at least a portion of the display device in the first mode to provide voltage levels at the display element to vary according to pulse density, wherein one or more of the display elements, which are each connected between a common and segment connection point, are activated when a first average voltage magnitude across the segment connection point over a first period exceeds a first minimum average voltage, wherein the selection driver circuit comprises a second mode that selectively couples selected controls signals to common display connection points, wherein the control signals selectively coupled to the common display connection points are varied according to a predetermined sequence, and selectively couples selected control signals to segment connection points, wherein the control signals selectively coupled to the segment connection points selectively correlate with at least one of the control signals selectively coupled to the common display connection points in response to at least display data to exceed a second minimum average voltage over a second time period; wherein a display element is activated or not activated depending upon whether a voltage exceeds the second minimum average voltage over the second time period.

13. The system of claim 12, wherein the signal generator circuit generates a plurality of intensity signals that substantially do not correlate with the control signals, and wherein the signal generator circuit further comprises an intensity varying circuit that logically combines the intensity signals with signals output from the selection driver circuit.

14. The system of claim 12, wherein:

the selection driver circuit generates at least one control signal having a predetermined frequency in the first mode; and a display structure coupled to the common and segment connection points comprises an inherent capacitance that forms at least a portion of a frequency filter, the predetermined frequency being outside a passband of the frequency filter.

15. The system of claim 12, wherein the first signal generator circuit and the selection circuit of the plurality of programmable digital logic blocks are configured with configuration data.

16. The system of claim 12, wherein a liquid crystal display is coupled to the common and segment connection points.

17. The system of claim 12, wherein the plurality of programmable digital blocks are further configured to comprise a second signal generator circuit that generates additional control signals that vary between substantially only two levels and have predetermined correlations with respect to one another.

18. The system of claim 17, wherein:

the selection driver circuit comprises:

a common section that time division multiplexes the control signals to a plurality of common connection points in the predetermined sequence, and a segment section that time division multiplexes the control signals to a plurality of common connection points in response to the at least display data.

* * * * *